US006099358A

United States Patent [19]

Sugiyama

[11] Patent Number: 6,099,358

[45] Date of Patent: Aug. 8, 2000

[54] CONNECTOR AND CONNECTING STRUCTURE FOR CONNECTOR

[75] Inventor: Norio Sugiyama, Shizuoka-ken, Japan

[73] Assignee: Yazaki Corporation, Tokyo, Japan

[21] Appl. No.: 09/065,628

[22] Filed: Apr. 24, 1998

[30] Foreign Application Priority Data

Apr. 28, 1997 [JP] Japan ..... 9-111521

[51] Int. Cl.[7] ..... H01R 13/514

[52] U.S. Cl. ..... 439/686

[58] Field of Search ..... 439/686, 682, 439/689, 695, 595, 660, 603

[56] References Cited

U.S. PATENT DOCUMENTS 4,460,235 7/1984 Gelin ..... 429/686

FOREIGN PATENT DOCUMENTS 4-188579 7/1992 Japan .

*Primary Examiner*—Steven L. Stephan
*Assistant Examiner*—Eugene G. Byrd
*Attorney, Agent, or Firm*—Finnegan, Henderson, Farabow, Garrett & Dunner, L.L.P.

[57] ABSTRACT

A connector is provided with a first housing and a cover. The first housing has a terminal receiving chamber in which a first terminal is received, and is fitted to a second housing. The second housing has a second terminal conducted and connected to the first terminal when the first housing is fitted to the second housing. The cover has a first engaging portion engageable with the first housing, a second engaging portion engageable with the second housing fitted to the first housing, and a come-out prevention portion for preventing the first terminal from coming out from the terminal receiving chamber. The cover is held to the first housing by an engagement between the first engaging portion and the first housing, and is held to the second housing by an engagement between the second engaging portion and the second housing. Accordingly, the cover is hard to be removed from the first housing, so that the first terminal is securely prevented form being come out from the terminal receiving chamber of the first terminal.

10 Claims, 5 Drawing Sheets

CONNECTOR AND CONNECTING STRUCTURE FOR CONNECTOR

BACKGROUND OF THE INVENTION

The present invention relates to a connector which securely prevents a terminal received in a terminal receiving chamber of a housing from coming out, and to a connecting structure using the connector.

A conventional connector of this kind includes a structure shown in FIGS. 1A and 1B (refer to Japanese Patent Unexamined Publication No. 4-188579).

As shown in FIGS. 1A and 1B, a connector 100 is provided with a connector housing 101 and a double lock member 102. A latch arm 109 of the double lock member 102 moves downward in the drawing from a state shown in FIG. 1B and engages with an engaging shoulder portion 110 of the connector housing 101. Accordingly, the double lock member 102 is held by the connector housing 101.

Flexible lances 105 and 106, engaging with a terminal (not shown) so as to prevent the terminal from coming out, are projected into terminal receiving chambers 103 and 104 of the connector housing 101. Part portions 107 and 108 of the double lock member 102 when attached to the connector housing 101, are brought into contact with the lance 105 within the terminal receiving chambers 103 and 104 so as to restrict an elastic deformation thereof. Accordingly, the terminal is prevented from coming out of the terminal receiving chambers 103 and 104.

However, in the conventional connector 100, since the double lock member 102 is held to the connector housing 101 only by engagement between the latch arm 109 and the engaging shoulder portion 110, the double lock member 102 comes out from the connector housing 101 when the double lock member 102 is strongly pulled, so that there is a risk that the terminal will come out from the terminal receiving chamber. Particularly, in the case that the terminal is pulled in an inclined direction, the double lock member 102 easily comes out.

SUMMARY OF THE INVENTION

Accordingly, the present invention is made in order to solve the problems mentioned above, and an object of the present invention is to provide a connector which can securely prevent a terminal from coming out from a terminal receiving chamber.

In order to achieve the object mentioned above, in accordance with the present invention, there is provided a connector comprising:

a housing having a terminal receiving chamber in which a first terminal is received, the first terminal being conducted and connected with a second terminal in an opposing part when the housing is fitted to the opposing part; and an attachment having a first engaging portion engageable with the housing, a second engaging portion engageable with the opposing part fitted to the housing and a come-out preventing portion for preventing the first terminal from coming out from the terminal receiving chamber, the attachment being held to the housing by an engagement between the first engaging portion and the housing, and the attachment held to the housing being held to the opposing part by an engagement between the second engaging portion and the opposing part.

In the structure mentioned above, since the attachment is securely held to the housing and the opposing part by the first and second engaging portions. The first terminal is securely prevented from being pulled from the terminal receiving chamber.

DESCRIPTION OF THE PREFERRED EMBODIMENTS

An embodiment in accordance with the present invention will be described below with reference to the drawings.

Figure 1A:
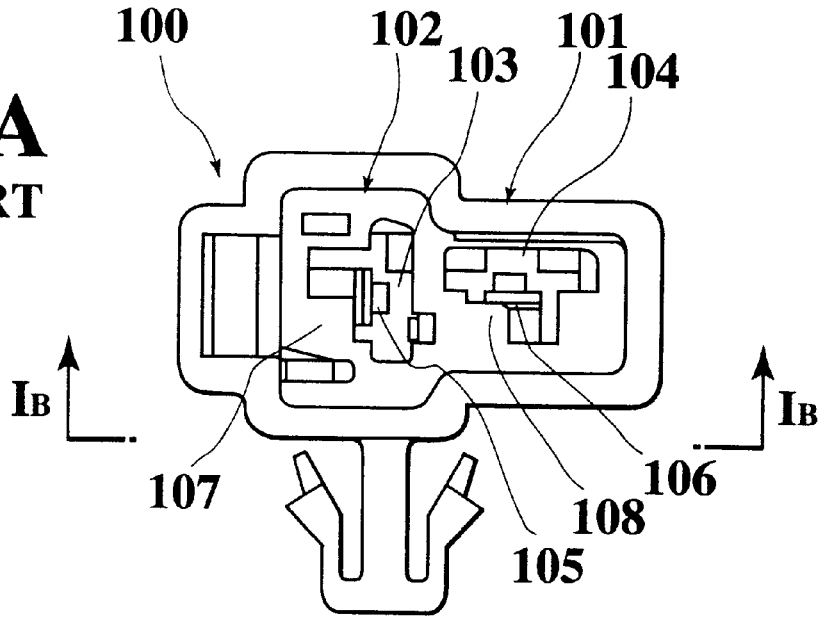
FIG.1A PRIOR ART
FIG. 1A is a plan view which shows a connector in accordance with a conventional embodiment.
Figure 1B:
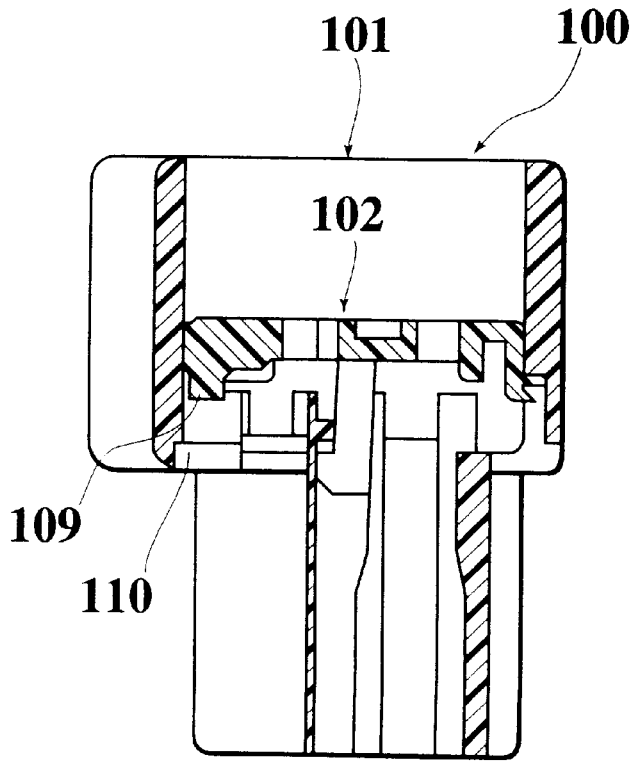
FIG.1B PRIOR ART
FIG. 1B is a cross sectional view along a line IB—IB in FIG. 1A.
Figure 2:
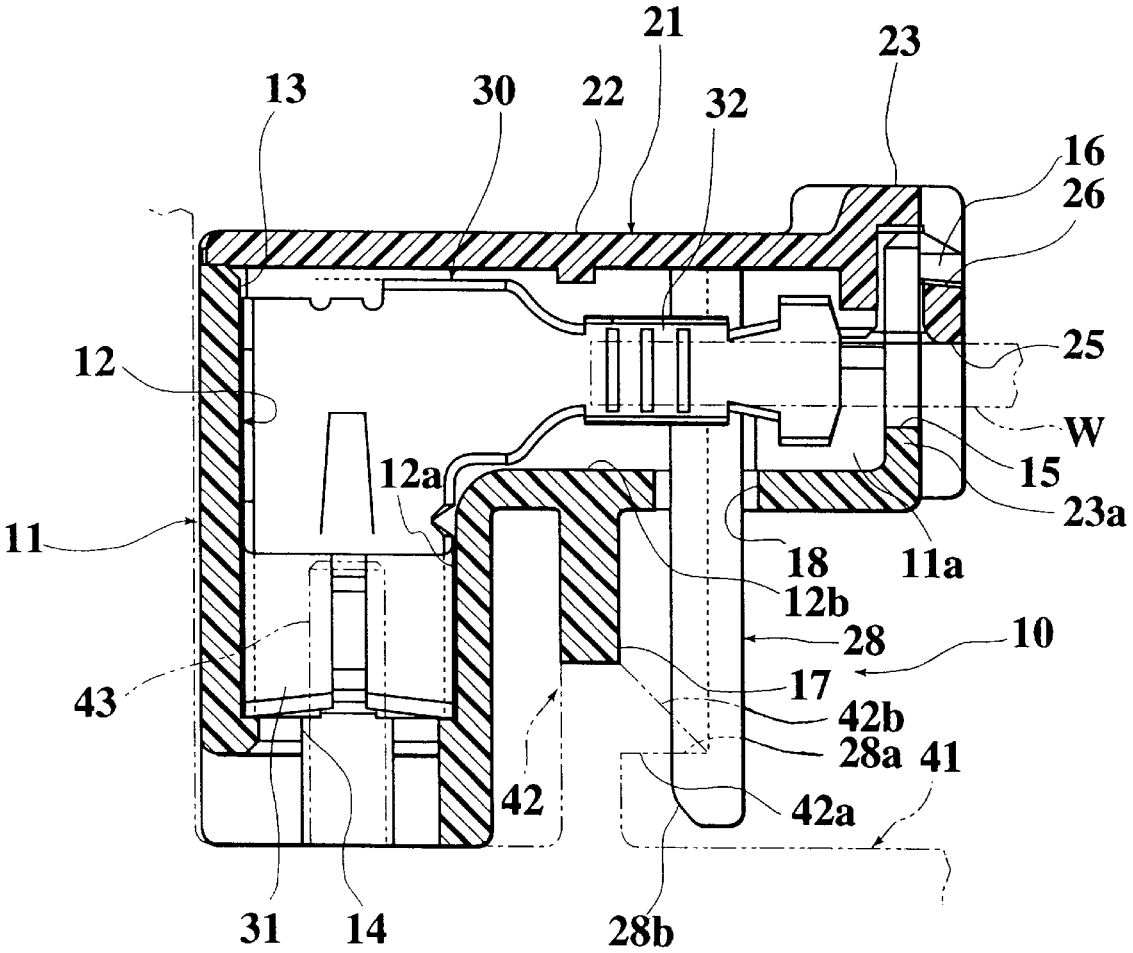
FIG. 2 is a cross sectional view which shows a connector in accordance with an embodiment of the present invention.

FIG. 2 is a cross sectional view which shows a connector in a state that a cover is mounted to a first housing. In the following description, a vertical direction and a lateral direction respectively indicate directions within FIG. 2.

As shown in FIG. 2, a connector 10 is provided with a first housing 11 and a cover 21 serving as an attachment. The connector 10 is connected to a second housing 41 as an opposing part fitable to the first housing. The first housing 11 has a terminal receiving chamber 12 for receiving a female terminal 30 (a first terminal). A male terminal 43 (a second terminal) in correspondence to the female terminal 30 is held to the second housing 41. The first housing 11, the second housing 41 and the cover 21 are made of a synthetic resin.

The female terminal 30 is formed substantially in an L shape, and has a contact portion 31 into which the male terminal 43 is inserted so as to be electrically connected and an electric wire connecting portion 32 to which an electric wire W is connected.

As shown in FIGS. 3 to 6, the first housing 11 and the cover 21 are connected through a band 20, and the first housing 11, the cover 21 and the band 20 are integrally formed by a mold formation.

Figure 4:
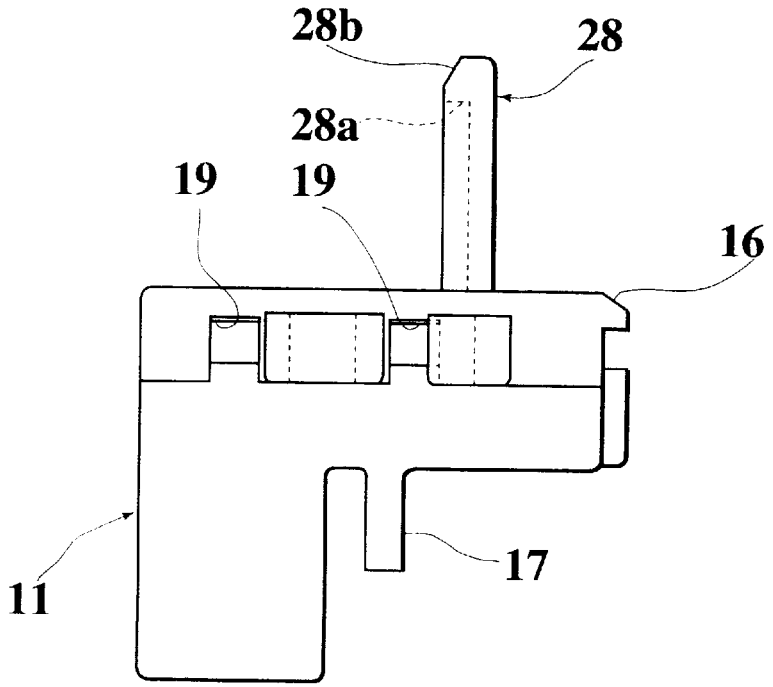
FIG. 4 is a side elevational view which shows the first housing and the cover in FIG. 2.

As shown in FIGS. 2 and 4, in the first housing 11, a side surface is formed in an L-shaped box. An inner space of the first housing 11 is separated into two terminal receiving chambers 12 by a central partition wall 11*a*. Each of the terminal receiving chambers 12 is formed in an L shape having a vertical portion 12*a* and a horizontal portion 12*b*. A contact portion 31 of a female terminal 30 is received in the vertical portion 12*a*. The vertical portion 12*a* of each of the terminal receiving chambers 12 has a terminal insertion port 14 in a front end (a lower end) thereof. When the first housing 11 is fitted into the second housing 41, the male terminal 43 held to the second housing 41 is inserted into the perpendicular portion 12*a* through the terminal insertion port 14 so as to be electrically connected to the contact portion 31 of the female terminal 30.

Figure 3:
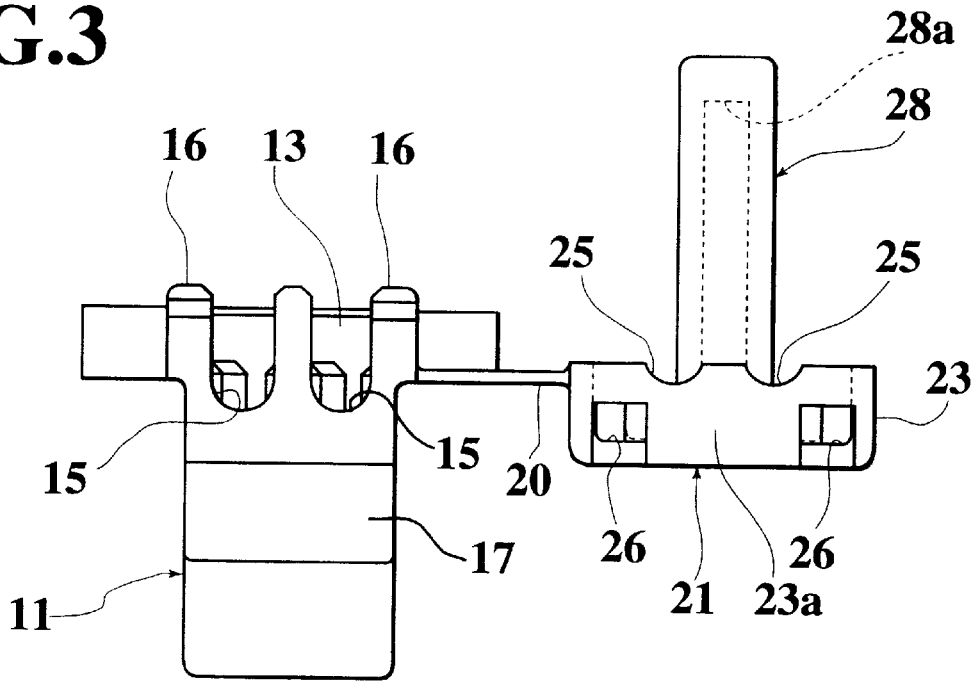
FIG. 3 is a front elevational view which shows a first housing and a cover in FIG. 2.
Figure 5:
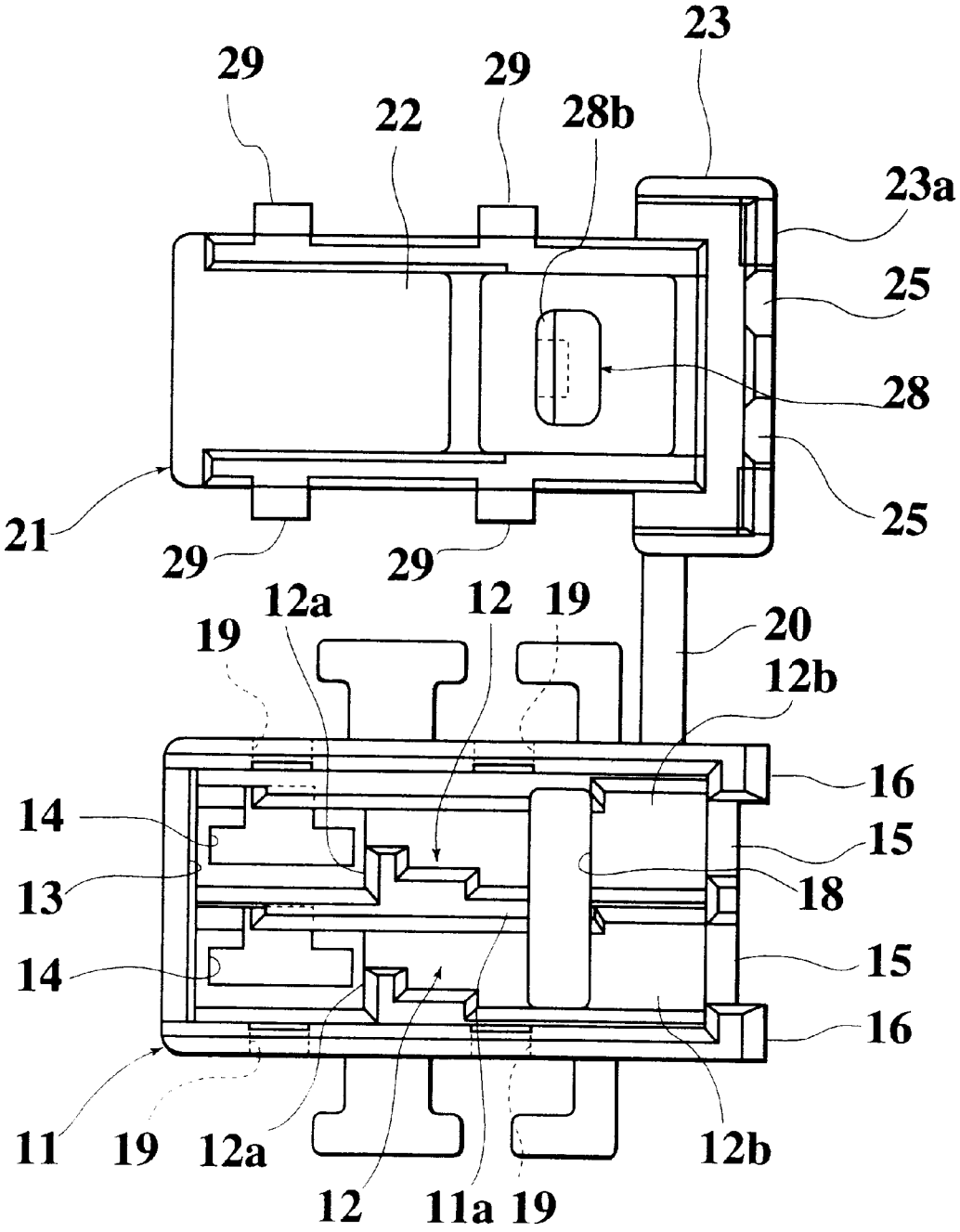
FIG. 5 is a plan view which shows the first housing and the cover in FIG. 2.
Figure 6:
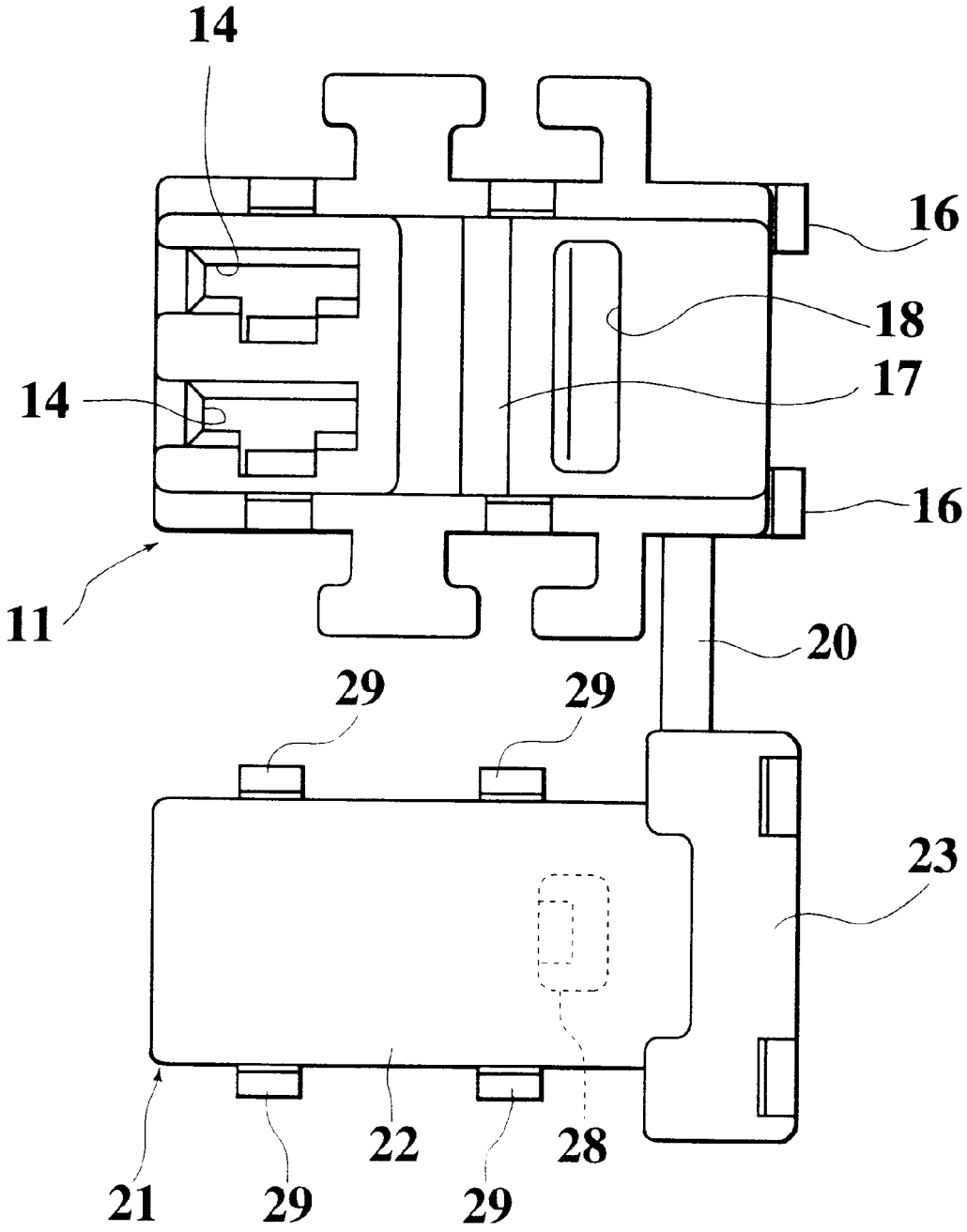
FIG. 6 is a bottom elevational view which shows the first housing and the cover in FIG. 2.

As shown in FIGS. 2, 3 and 5, the first housing 11 has an upper opening 13 as a path of the female terminal 30 into the receiving chamber 12. The upper opening 13 is arranged in the upper surface end of the horizontal portion 12*b* of the terminal receiving chamber 12. A recess portion 15 formed in a half circular shape is provided in a base end (a right end) of each of the horizontal portions 12*b*. An electric wire W pressed and connected to an electric wire pressing portion 32 of the terminal 30 is fitted into the recess portion 15. An L-shaped engaging protrusion 16 is projected upward from both sides of each of the recess portion 15. A projecting plate 17 is projected downward from a central lower surface wall of the first housing 11. The lower surface wall of the first housing 11 has a rectangular insertion hole 18 near the projecting plate 17. A pair of rectangular front and rear engaging holes 19 are respectively formed in front of (at the left end of) and substantially in the center of the both side walls of the first housing 11.

As shown in FIGS. 2 to 6, the cover 21 is mounted to the first housing 11 in such a manner as to close the upper opening 13 of the terminal receiving chamber 12. The cover 21 has a locking hole 26 and a locking hook 29 serving as a first engaging portion, a flexible arm 28 serving as a second engaging portion, and a planar plate portion 22 serving as a come-out prevention portion.

The cover 21 is formed substantially in a T shape (refer to FIG. 5), and has the planner plate portion 22 and a wide portion 23 provided in an end portion (a right end portion) of the planner plate portion 22. The planner plate portion 22 closes the upper opening 13 so as to prevent the female terminal 30 from coming out from the terminal receiving chamber 12. The wide portion 23 is formed substantially in a U-shaped cross section in such a manner that the engaging projections 16 of the first housing 11 are inserted into locking holes 26.

The wide portion 23 of the cover 21 has a front wall 23*a* in the end portion thereof (the right end portion). A pair of circular arc recess portions 25 and are formed in the lower portion of the front wall 23*a* in an opposing manner to the recess portions 15 of the first housing 11.

The locking hole 26 is provided in the front wall 23*a* of the wide portion 23 in an opposing manner to the engaging projection 16 of the first housing 11. Locking hooks 29 are provided in the planar plate portion 22 in an opposing manner to the engaging holes 19 of the first housing 11. When the cover 21 is mounted to the first housing 11, the locking holes 26 are engaged with the engaging projections 16 and the locking hooks 29 are engaged with the engaging holes 19. The cover 21 are held to the first housing 11 by an engagement between the locking holes 26 and the engaging projections 16 and an engagement between the locking hooks 29 and the engaging holes 19.

The flexible arm 28 projects from the inner surface of the planar plate portion 22 in the cover 21. The flexible arm 28 is inserted through the insertion hole 18 from the terminal receiving chamber 12 so as to be projected outside the first housing 11 at a time of mounting the cover 21 to the first housing 11. The flexible arm 28 has a projection 28*a* projecting to the projecting plate 17 in the front end (the lower end) of the center portion thereof.

The second housing 41 has a support plate 42 which is brought into contact with the projecting plate 17 of the first housing 21 so as to support the projecting plate 17 from the lower portion at a time of being fitted to the first housing 21. The support plate 42 has a protrusion 42*a* projecting in an opposing manner to the projection 28*a* of the flexible arm 28 in the front end (the upper end) thereof.

The projection 28*a* of the flexible arm 28 is engaged with the protrusion 42*a* of the support plate 42 when the cover 21 is mounted to the first housing 11 and the first housing 11 is fitted to the second housing 41. The cover 21 is held in the second housing 41 by an engagement between the protrusion 42*a* of the support plate 42 and the projection 28*a* of the flexible arm 28.

The projection 28*a* of the flexible arm 28 and the protrusion 42*a* of the support plate 42 respectively have tapered surfaces 28*b* and 42*b* which are brought into sliding contact with each other when the first housing 11 is fitted to the second housing 41.

In the case of assembling the connector 10, at first, both ends of the band 20 are cut and the first housing 11 and the cover 21 are separated from each other.

Next, the female terminal 30 is inserted from the upper opening 13 of the first housing 11, and the female terminal 30 is received at a predetermined position in each of the terminal receiving chambers 12. The contact portion 31 of the female terminal 30 is fitted into the vertical portion 12*a* and the electric wire connecting portion 32 is received into the horizontal portion 12*b*.

Next, the cover 21 is mounted to the first housing 11 in such a manner as to cover the upper opening 13. Accordingly, the connector 10 is assembled.

At this time, each of the locking hooks 29 and each of the locking holes 26 of the cover 21 are engaged with each of the engaging holes 19 and each of the engaging projections 16 of the first housing 11. In this state, the flexible arm 28 of the cover 21 projects outside the first housing 11 from the insertion hole 18 of the first housing 11. Further, the electric wire W connected to each of the female terminals 30 extends outward from the portion between each of the recess portions 15 in the first housing 11 and each of the recess portions 25 in the cover 21.

After the connector is assembled, as shown in FIG. 2, the first housing 11 is fitted into the second housing 41. At this time, the projection 28*a* on the flexible arm 28 of the cover 21 and the projection 42*a* on the support plate 42 of the second housing 41 are engaged with each other. An engagement between the projection 28*a* and the protrusion 42*a* can be easily achieved since the taper surfaces 28*b* and 42*b* are brought into sliding contact with each other, the fitting force of the first housing 11 acts on the flexible arm 28 through the taper surfaces 28*b* and 42*b* and the flexible arm 28 is easily bent. Further, each of the male terminals 43 of the second housing 41 is inserted into the contact portion 31 of one of the female terminals 30 within the first housing 11. Further, the support plate 42 of the second housing 41 is brought into contact with the lower surface of the projecting plate 17 in the first housing 11 so as to be supported.

In the fitting state mentioned above, since the cover 21 is held (via flexible arm 28) to both of the first housing 11 and the second housing 41, the cover 21 is hard to remove from the first housing 11. Further, since the support plate 42 is brought into contact with the lower surface of the projection plate 17 so as to be supported, an engaging state between the projection 28*a* and the protrusion 42*a* is more securely held, so that the cover 21 is further hard to be removed.

Further, each of the female terminals 30 is formed substantially in an L shape, and the contact portion 31 of each of the female terminals 30 is fitted into the vertical portion 12*a* of each of the terminal receiving chambers 12. Accordingly, even when the electric wire W connected to the electric wire connecting portion 32 is pulled in an inclined direction, the contact portion 31 is hard to remove from the vertical portion 12*a* and the female terminal 30 is hard to remove from each of the terminal receiving chambers 12.

As mentioned above, since the cover 21, serving as a removal prevention for the female terminal 30 within the first housing 11, has the locking hooks 29 engageable with the first housing 11 and the flexible arm 28 engageable with the second housing 41, the cover 21 is held to both of the first housing 11 and the second housing 41 when the first housing 11 to which the cover 21 is mounted is fitted to the second housing 41. Accordingly, the cover 21 is hard to remove from the first housing 11, the removal prevention function for the female terminal 30 by the cover 21 can be securely maintained, and the female terminal 30 can be securely prevented from coming out from each of the terminal receiving chamber 12.

Further, the flexible arm 28 of the cover 21 extends outward from the insertion hole 18 of the first housing 11 so as to be engaged with the protrusion 42*a* of the second housing 41. Accordingly, the protrusion 42*a* of the second housing 41 is provided perpendicular to the horizontal portion 12*b* of the first housing 11. As a result, the flexible arm 28 and the protrusion 42*a* are compactly combined so as to make the combined housings 11 and 41 compact.

Still further, since the taper surfaces 28*b* and 42*b*, being brought into sliding contact with each other, are provided in the projection 28*a* of the flexible arm 28 and the protrusion 42*a* of the support plate 42, the flexible arm 28 can be elastically deformed with ease when the first housing 11 is fitted into the second housing 41. Accordingly, the projection 28*a* and the protrusion 42*a* can be easily and securely engaged with each other.

Here, in the embodiment mentioned above, the projection 28*a* and the protrusion 42*a* are respectively provided in the cover 21 and the second housing; however, the projection 28*a* or the protrusion 42*a* may alternatively be formed in a hole shape.

Further, the projecting plate 17 being brought into contact with the support plate 42 of the second housing 41 is provided in the first housing 21, however, the support plate of the second housing 41 may be shaped such that it can be directly brought into contact with the lower surface wall of the first housing without providing the projecting plate 17.

Still further, the opposing member is not limited to the second housing 41, and for example, it may be an electric connecting box or the like.

What is claimed is:

1. A connector comprising:

a housing having a terminal receiving chamber in which a first terminal is received, the first terminal being connected with a second terminal in an opposing part when the housing is fitted to the opposing part; and a cover having a first engaging portion engageable with the housing, and a second engaging portion engageable with the opposing part, and a removal preventing portion for preventing removal of the first terminal from the terminal receiving chamber, the cover being held to the housing by an engagement between the first engaging portion and the housing, and the cover being held to the opposing part by an engagement between the second engaging portion and the opposing part.

2. A connector as recited in claim 1, wherein the housing has an insertion hole, and the second engaging portion is inserted into the insertion hole from the terminal receiving chamber so as to be projected outside the housing when the cover is held to the housing.

3. A connector as recited in claim 1, wherein the second engaging portion is a flexible arm having a projection on a distal end thereof, and the projection includes a tapered surface which is brought into sliding contact with the opposing part so as to elastically deform the flexible arm when the housing is fitted into the opposing part.

4. A connector as recited in claim 1, wherein the cover is positioned in the terminal receiving chamber so as to prevent removal of the first terminal from the terminal receiving chamber.

5. A connecting structure for a connector, comprising:

a housing having a terminal receiving chamber in which a first terminal is received;

an opposing part fitted to the housing, the opposing part having a second terminal connected to the first terminal when the housing is fitted to the opposing part; and a cover having a first engaging portion engageable with the housing, a second engaging portion engageable with the opposing part, and a removal preventing portion for preventing removal ol the first terminal from the terminal receiving chamber, the cover being held to the housing by an engagement between the first engaging portion and the housing, and the cover being held to the opposing part by an engagement between the second engaging portion and the opposing part.

6. A connecting structure for a connector as recited in claim 5, wherein the housing has an insertion hole, and the second engaging portion is inserted into the insertion hole from the terminal receiving chamber so as to be projected outside the housing when the cover is held to the housing.

7. A connecting structure for a connector as recite in claim 5, wherein the second engaging portion is a flexible arm having a projection on a distal end thereof, the opposing part has a protrusion engageable with the projection of the arm, and the projection includes a tapered surface which is brought into sliding contact with the protrusion so as to elastically deform the flexible arm when the housing is fitted into the opposing part.

8. A connecting structure for a connector as recited in claim 5, wherein the second engaging portion is a flexible arm having a projection on a distal end thereof, the opposing part has a protrusion engageable with the projection of the arm, and the protrusion includes a tapered surface which is brought into sliding contact with the projection so as to elastically deform the flexible arm when the housing is fitted into the opposing part.

9. A connecting structure for a connector as recited in claim 5, wherein the cover is positioned in the terminal receiving chamber so as to prevent removal of the first terminal from the terminal receiving chamber.

10. A connecting structure for a connector as recited in claim 5, wherein the opposing part is a second housing.

* * * * *

UNITED STATES PATENT AND TRADEMARK OFFICE

CERTIFICATE OF CORRECTION

PATENT NO. : 6,099,358
DATED : August 8, 2000
INVENTOR(S) : Norio Sugiyama

It is certified that error appears in the above-identified patent and that said Letters Patent is hereby corrected as shown below:

Title page,
Item [57], ABSTRACT, line 17, "form being come" should read -- from coming --.

Column 6, claim 5,
Line 23, "ol" should read -- of --.

Column 6, claim 7,
Line 36, "recite" should read -- recited --.

Signed and Sealed this

Ninth Day of April, 2002

*Attest:*

*Attesting Officer*

JAMES E. ROGAN
*Director of the United States Patent and Trademark Office*